US009309692B2

(12) United States Patent
Westwinkel

(10) Patent No.: US 9,309,692 B2
(45) Date of Patent: Apr. 12, 2016

(54) LOCKING CORE WITH RELEASABLE CLASP FOR DRIVER

(75) Inventor: Florian G. Westwinkel, Toronto (CA)

(73) Assignee: WESKO SYSTEMS LIMITED, Mississauga, Ontario (CA)

( * ) Notice: Subject to any disclaimer, the term of this patent is extended or adjusted under 35 U.S.C. 154(b) by 714 days.

(21) Appl. No.: 12/784,991

(22) Filed: May 21, 2010

(65) Prior Publication Data

US 2010/0300160 A1 Dec. 2, 2010

(51) Int. Cl.
*E05B 9/08* (2006.01)

(52) U.S. Cl.
CPC . *E05B 9/084* (2013.01); *E05B 9/08* (2013.01); *E05B 9/086* (2013.01); *Y10T 70/5097* (2015.04); *Y10T 70/8486* (2015.04)

(58) Field of Classification Search
USPC ..... 70/370, 371, 372, 379 R
See application file for complete search history.

(56) References Cited

U.S. PATENT DOCUMENTS

| | | | | | |
|---|---|---|---|---|---|
| 2,948,141 | A | * | 8/1960 | Vahlstrom | 70/370 |
| 4,381,656 | A | * | 5/1983 | Hayakawa | 70/451 |
| 4,910,982 | A | * | 3/1990 | Dana | 70/370 |
| 4,995,249 | A | | 2/1991 | Preissler et al. | |
| 5,121,618 | A | | 6/1992 | Scott | |
| 5,251,467 | A | | 10/1993 | Anderson | |
| 5,636,540 | A | * | 6/1997 | Myers | 70/370 |
| 5,752,400 | A | | 5/1998 | Kim | |
| 6,012,311 | A | * | 1/2000 | Duckwall | 70/369 |
| 6,014,877 | A | * | 1/2000 | Shen | 70/371 |
| 6,079,240 | A | | 6/2000 | Shvarts | |
| 6,105,405 | A | * | 8/2000 | Westwinkel | 70/371 |
| 6,161,404 | A | * | 12/2000 | Westwinkel | 70/370 |
| 6,393,882 | B1 | * | 5/2002 | Higgins | 70/370 |
| 6,568,229 | B1 | * | 5/2003 | Heinrich | 70/370 |
| 6,644,076 | B2 | * | 11/2003 | Huang | 70/379 R |
| D491,045 | S | * | 6/2004 | Laabs et al. | D8/343 |
| 6,901,638 | B2 | * | 6/2005 | Itou et al. | 24/570 |
| 7,104,098 | B2 | | 9/2006 | Romero et al. | |
| 7,634,930 | B2 | | 12/2009 | Boesel et al. | |
| 2013/0312468 | A1 | | 11/2013 | Read et al. | |

* cited by examiner

*Primary Examiner* — Christopher Boswell
(74) *Attorney, Agent, or Firm* — Squire Patton Boggs (US) LLP

(57) ABSTRACT

A cylindrical locking core suitable for retrofit and new installations has a coupling to releasably engage a driver in a locking system. The coupling, for example, a clip, has a base which fits into a channel in the core, to grasp the core. The clip also includes two opposing flexible, resilient arms to releasably grasp the driver. The arms have rigid flanges which engage recesses in the driver. The core may be disengaged from the driver by rotating the core relative to the driver, using a change key. When the core is in use, an operating key extends through the core and an opening in the coupling, to engage the driver, to open and close the lock system.

20 Claims, 19 Drawing Sheets

LOCKING CORE WITH RELEASABLE CLASP FOR DRIVER

FIELD OF THE INVENTION

The present invention relates to locking mechanisms used in filing and storage cabinets, furniture and other lockable storage compartments.

BACKGROUND OF THE INVENTION

Many known locking systems incorporate locking cores which engage locking systems within storage compartments, cabinets, furniture and other storage units. In some instances, these locking cores may be removed, albeit with difficulty, for retrofitted replacement with new locking cores when the original locking cores become worn, broken or inoperable. When removed from their original installation, these original locking cores are often unsuitable for reinstallation. Often, these known locking cores are not intended or designed for reuse after removal. Other known locking cores are prone to failure because of the methods used to manufacture those locking cores.

U.S. Pat. Nos. 4,761,978 and 4,914,932 to Walla disclose a locking core made of a single cast material having two opposing legs which are designed to engage a lock system. However, since such legs are typically cast from a relatively inflexible, and often brittle material, the legs are unsuitable for repeated removal or reuse after extraction from an existing installation. The legs disclosed in Walla were prone to being bent, damaged or distorted during an installation step or during extraction, thus creating potential or actual weaknesses in locking systems.

Attempts were made to improve the locking core design disclosed in Walla as further described below in the context of another known locking core design which incorporates modifications intended to overcome some of the problems associated with the previously known inflexible, brittle legs described above.

SUMMARY OF THE INVENTION

In one aspect, a cylindrical locking core has a coupling to releasably engage a driver in a locking system. The coupling is suitable for use in retrofit and new installations. In retrofit installations, worn or broken locking cores may be removed from existing locking systems, including office furniture and cabinets, for replacement with locking cores of the present invention. Often, these existing locking systems include an array of vertically stacked sliding bars, to selectively lock two or more storage compartments in one storage unit. The locking core, when in use and coupled with the driver, activates the locking system to selectively lock and unlock the storage compartments. In some instances, the locking systems are integrated with anti-tip systems to prevent the simultaneous opening of more than one unlocked storage compartment, and thus avoid the storage unit from toppling over during operation.

In one example of the invention, the coupling is a clip, having a base which fits into a channel in the locking core, to grasp the core. The locking core is elongated and it defines a longitudinal axis. The clip also includes two opposing, flexible, resilient arms extending along the axis, to releasably grasp the driver when the locking core, including the coupling, is in use. The flexible arms have rigid flanges which releasably engage corresponding recesses in the driver. The flexibly resilient coupling may be used to releasably secure the locking core to the driver without necessarily aligning the locking core with the driver prior to engagement. In one aspect, the core may be disengaged from the driver by rotating the core relative to the driver, using a change key.

When the change key is inserted into the locking core of the preferred embodiment, the change key extends through the locking core, thus activating the lock tumblers in the locking core, to permit rotation of the locking core to a predetermined position for disengagement, within a lock housing included in the locking system. To remove the core (including the coupling) and detach the core from the driver, the change key is turned to the predetermined position by rotating the locking core (including the coupling) relative to the driver, so that the rigid flanges exit from the corresponding recesses in the driver, to permit disengagement of the locking core from the driver.

When the locking core of the preferred embodiment is in use, an operating key extends through the core, thus activating the lock tumblers in the locking core, to permit rotation of the locking core, preferably in a second direction, within the lock housing. The operating key extends through the core, and through an opening in the coupling, into a portion of the driver, to engage the driver, to open and close the lock system. In the preferred embodiment, the operating key is not used to disengage the locking core from the driver.

In another aspect, the invention is a cylindrical locking core extending along a longitudinal axis. A channel runs across the axis of the locking core. The channel defines a plane extending transversely across the axis. In this aspect, the coupling comprises a flexibly resilient clip. The base of the clip nests within the channel, to secure the clip to the locking core. When the locking core is installed within the lock housing of the locking system for use, the clip engages and secures the driver in the locking assembly to the locking core. The clip may be disengaged from the driver by using the change key to rotate the lock cylinder relative to the driver to a position in which the locking core (including the clip) may be removed away from the driver.

In another aspect of the invention, a cylindrical locking core is provided for use in a locking assembly for selectively locking and unlocking a storage unit. A longitudinal axis extends along the length of the locking core. The locking core defines a channel extending transversely across the axis. A flexibly resilient coupling comprises a base for engaging the channel, and when in use, the coupling releasably secures the locking core to a driver in the locking assembly.

The channel may define either (a) a planar surface extending across the axis or (b) an arcuate path extending transversely about the axis. The coupling may be a flexibly resilient clip. In a preferred embodiment, the base of the clip is snap-fitted into the channel.

Preferably, the locking core is cast from a rigid first material and the coupling is formed from one or more other materials, consisting essentially of flexibly resilient steel. In the preferred aspect, the coupling includes a pair of opposing flexibly resilient arms extending coaxially away from the base. The arms are biased inwardly for movement toward the axis. Preferably, the arms define a pair of opposing rigid flanges projecting inwardly toward the axis for releasably engaging a pair of corresponding projections or recesses defined by the driver. The flexibly resilient arms may deflect outwardly away from the longitudinal axis when the locking core is moved toward the driver, to removably engage the locking core with the driver.

Preferably, when the locking core is installed in a locking system for use, the locking core operates between a first position and a second position for locking and unlocking an associated storage compartment. The locking core operates between the first position and a third position, or between the second position and the third position, for rotational disengagement of the locking core from the driver.

In another aspect, the invention is embodied in a storage unit comprising a storage compartment. The storage compartment includes an embodiment of the locking core as described herein. The storage unit includes a locking mechanism associated with the storage compartment, the locking core is detachably secured to the driver, and the locking core operates between (i) a first position in which the storage compartment is prevented from opening and (ii) a second position in which the storage compartment may be opened. The locking core operates between the first position and a third position, or between the second position and a third position, so that in the third position the locking core is detachable from the driver. Preferably, the locking core is detachable from the driver by rotating the locking core to the third position. The locking core is operable between the first position and the second position by rotating a first key about the longitudinal axis. The locking core is operable between the first position and the third position, or between the first position and the third position, by rotating a second key about the longitudinal axis.

Other aspects of the invention will become apparent to those persons who are skilled in the art upon reading the following detailed description, drawings and appended claims.

IN THE DRAWINGS

Figure 18:
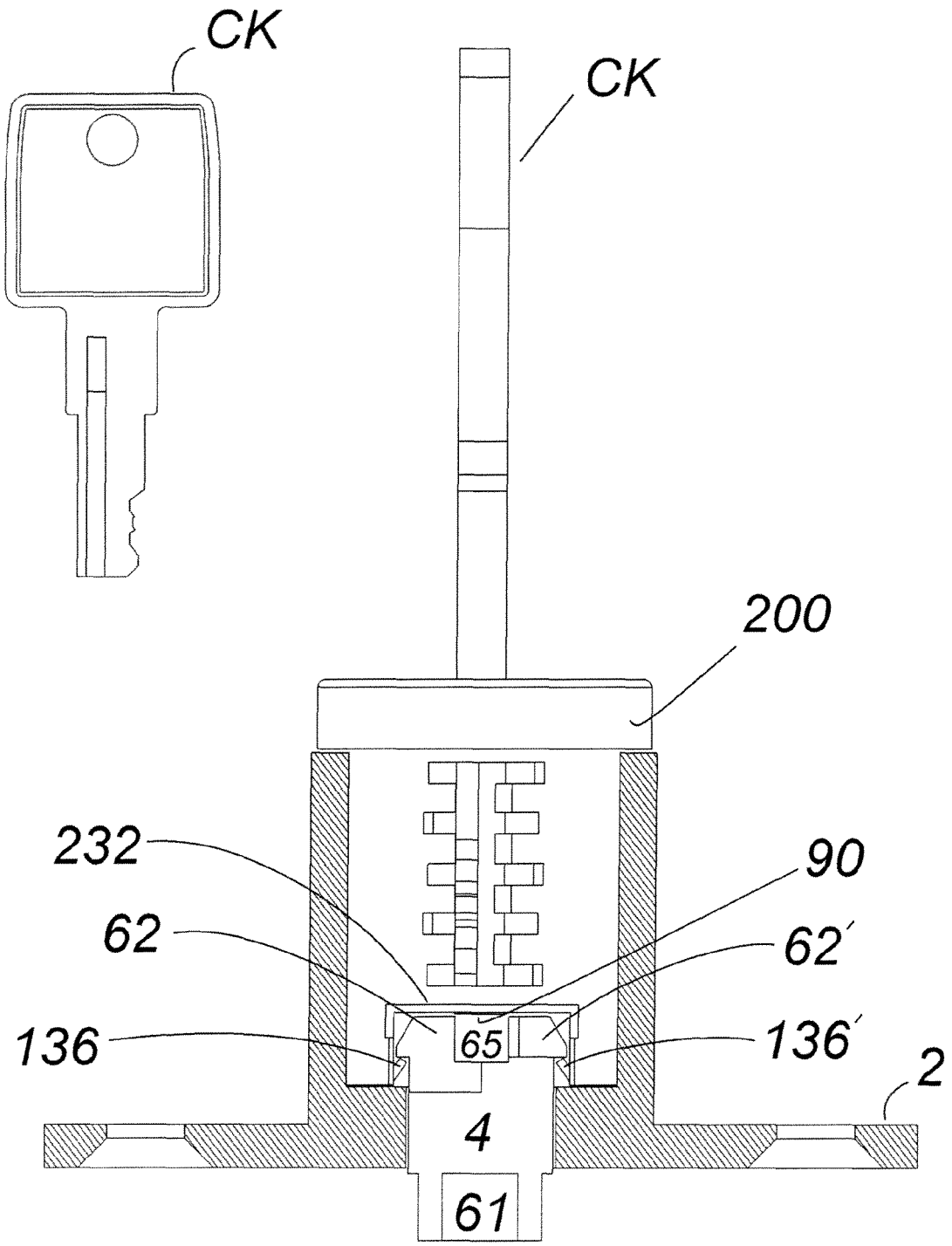
FIG. 18 is a frontal view, in partial section, of the second embodiment of the locking core and clip, in which a change key is inserted into the locking core, while the locking core and driver are engaged.
Figure 19:
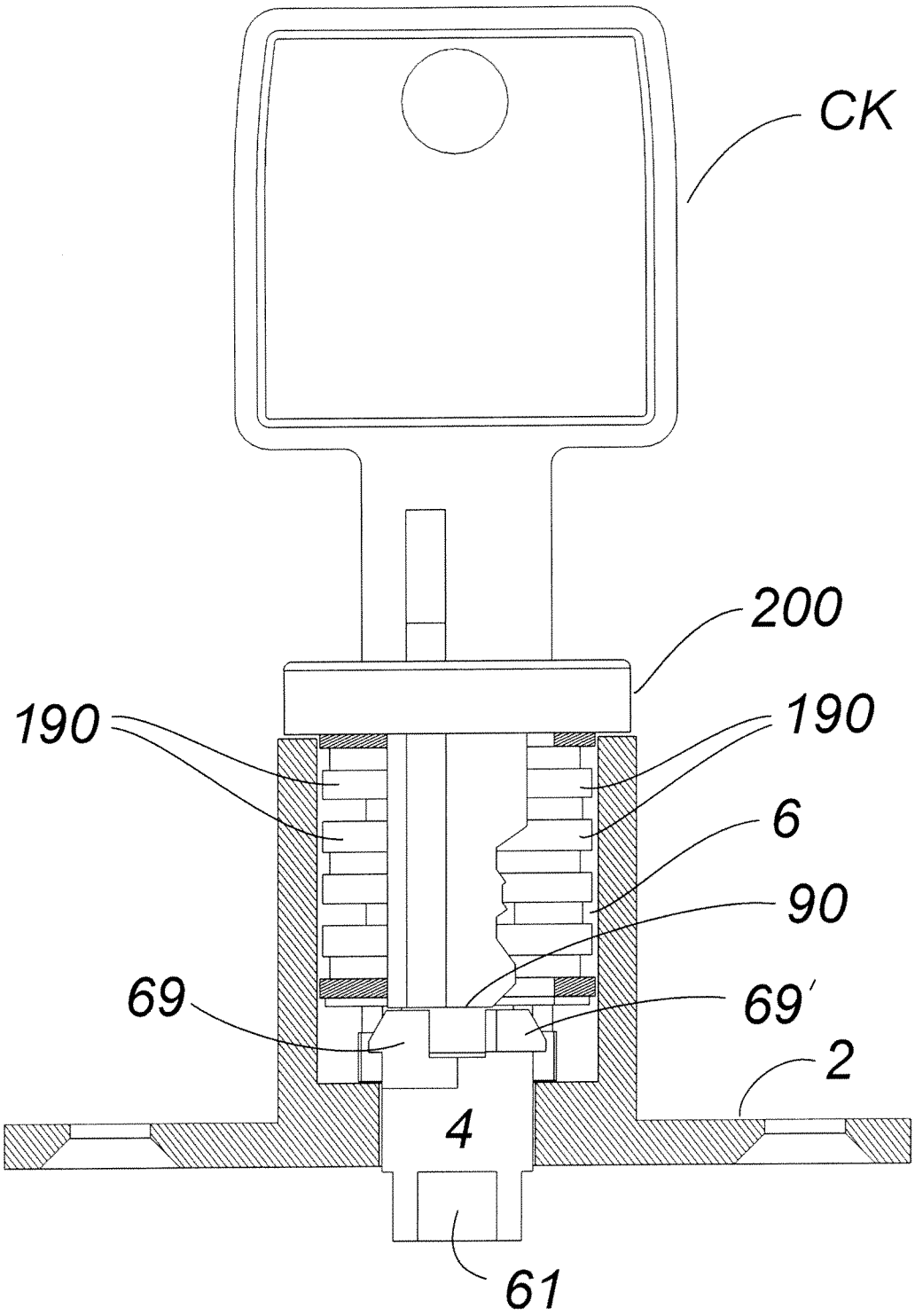
Figure 20:
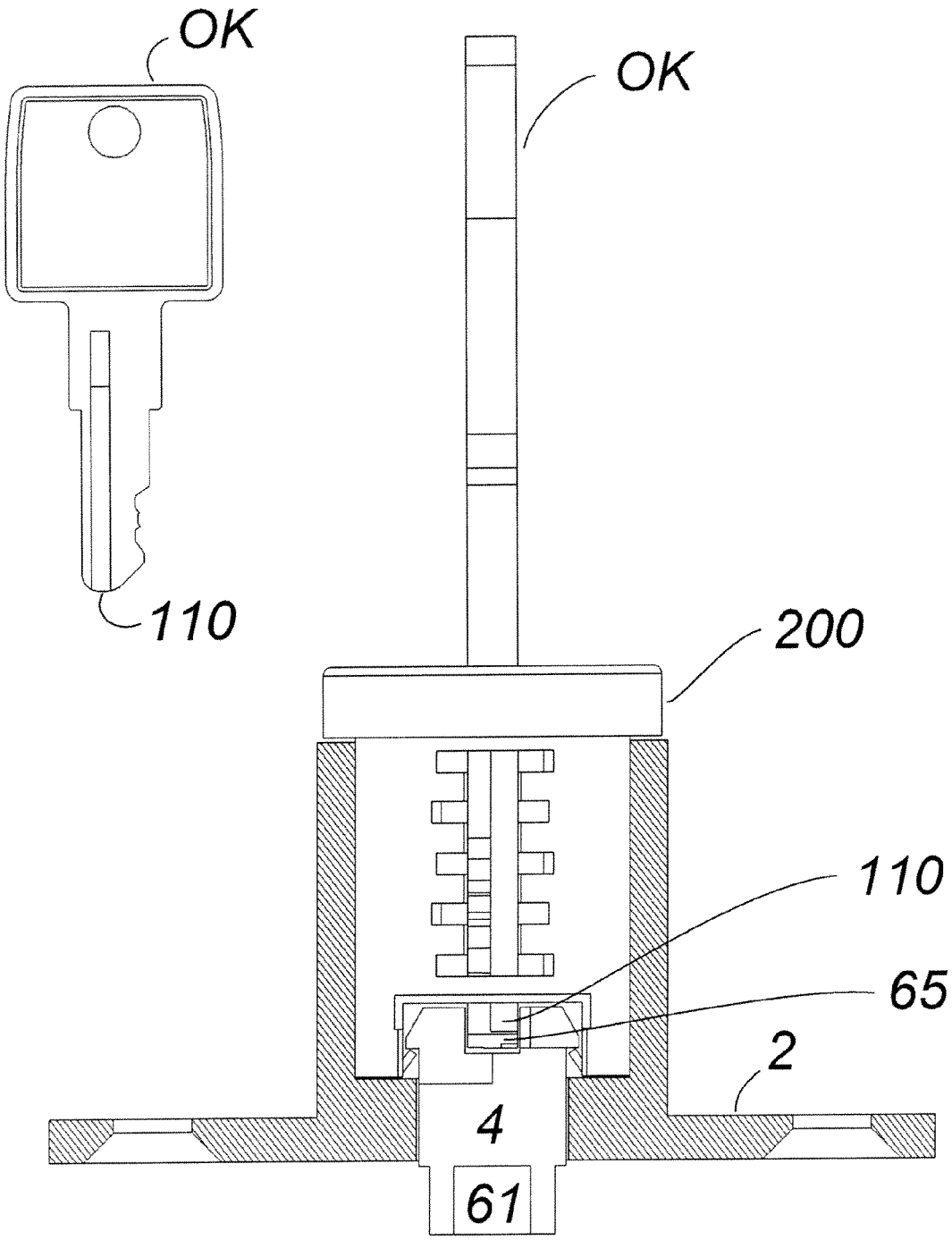

FIG. 19 is a frontal view, in partial section, of the second embodiment of the locking core and clip, in which the change key and the locking core have been rotated relative to the illustrated position in FIG. 18, and the locking core and driver are in position for disengagement; and FIG. 20 is a frontal view, in partial section, of the second embodiment of the locking core and clip, in which an operating key is inserted through the locking core and into the driver, for operating the locking core and driver between locked and unlocked positions.

DESCRIPTION OF THE PREFERRED EMBODIMENTS OF THE INVENTION

Figure 1:
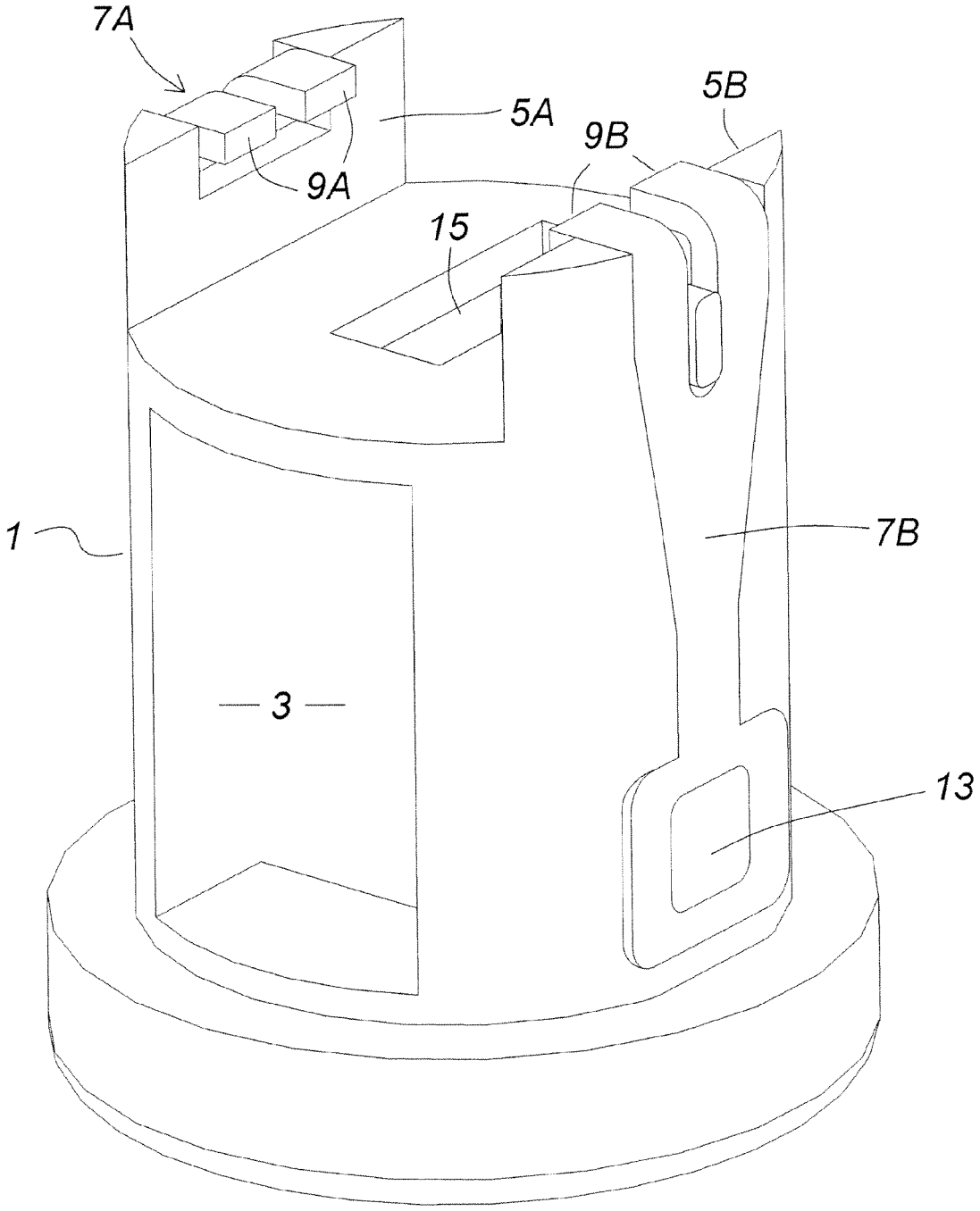
Prior Art Fig 1
FIG. 1 is a perspective view of an example of a known locking core.

An example of a known locking core 1 is shown in FIG. 1. The core 1 is illustrated as an elongated cylindrical body defining a cylinder cavity 3 extending across the cylindrical body to provide openings at opposite sides of the locking core. The cylinder cavity 3 is sufficiently large and clear of internal obstructions to permit rivets 13 to be secured to the core 1 during manufacture. A keyway 15 extends along a longitudinal axis defined by the locking core 1, providing key openings at opposite ends of the longitudinal axis. Parallel cylinder legs 5A, 5B which are cast together with the cylinder body 1 from a single material, extend outwardly along the axis. Elongated arms 7A,7B are made of a flexible steel material secured to the locking core 1 by a corresponding pair of rivets 13, positioned on opposite sides of locking core 1. The elongated arms 7A, 7B are provided with paired tines 9A, 9B. In this design, the cylinder cavity 3 was intended to house an array of metal tumblers and plastic spacers (not shown) to separate adjacent tumblers, such that the tumblers would extend outwardly from the axis, on opposite sides of the locking core 1, when the locking core was in the locked position. When an operating key (not shown) was inserted, the tumblers would be retracted inwardly, to permit rotation of the locking core within a lock housing (not shown), to operate an associated locking system between locked and unlocked positions. A change key (not shown) would be inserted to retract the tumblers to permit the rotation of the locking core within the lock housing and to permit extraction of the locking core from the lock housing. However, the thermoplastic spacer components inserted into the locking core 1 were prone to premature wear, distortion or melting under high temperatures and other problems tending to interfere with the smooth rotational operation of the locking core 1 during locking and unlocking steps.

FIGS. 2-11 provide a simplified illustration of a first embodiment of the present invention in which the keyed tumblers and tumbler array are not shown.

Figure 2:
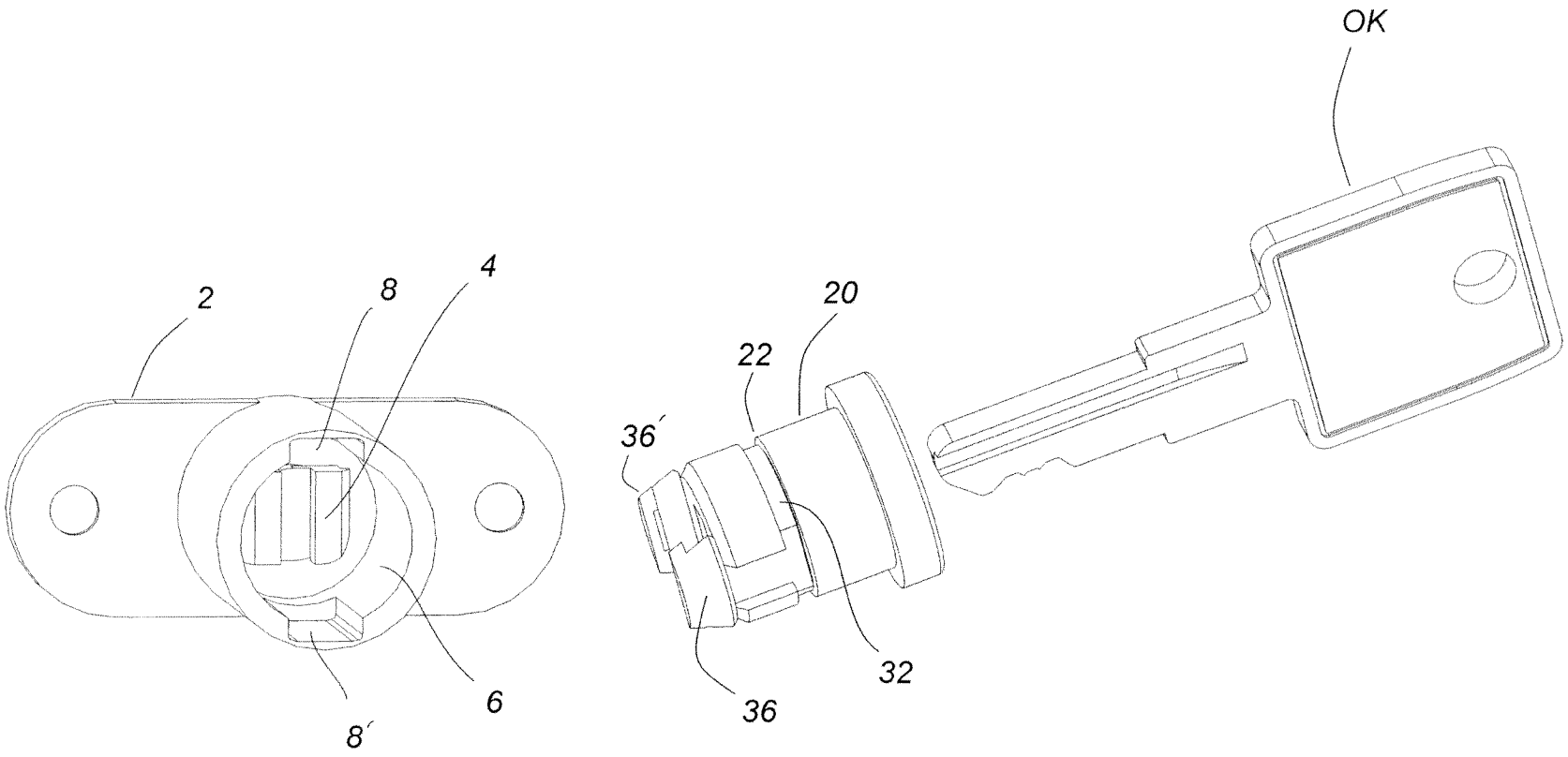
FIG. 2 is an exploded view of a first embodiment of a locking core of the invention along with a lock housing and operating key.
Figure 3:
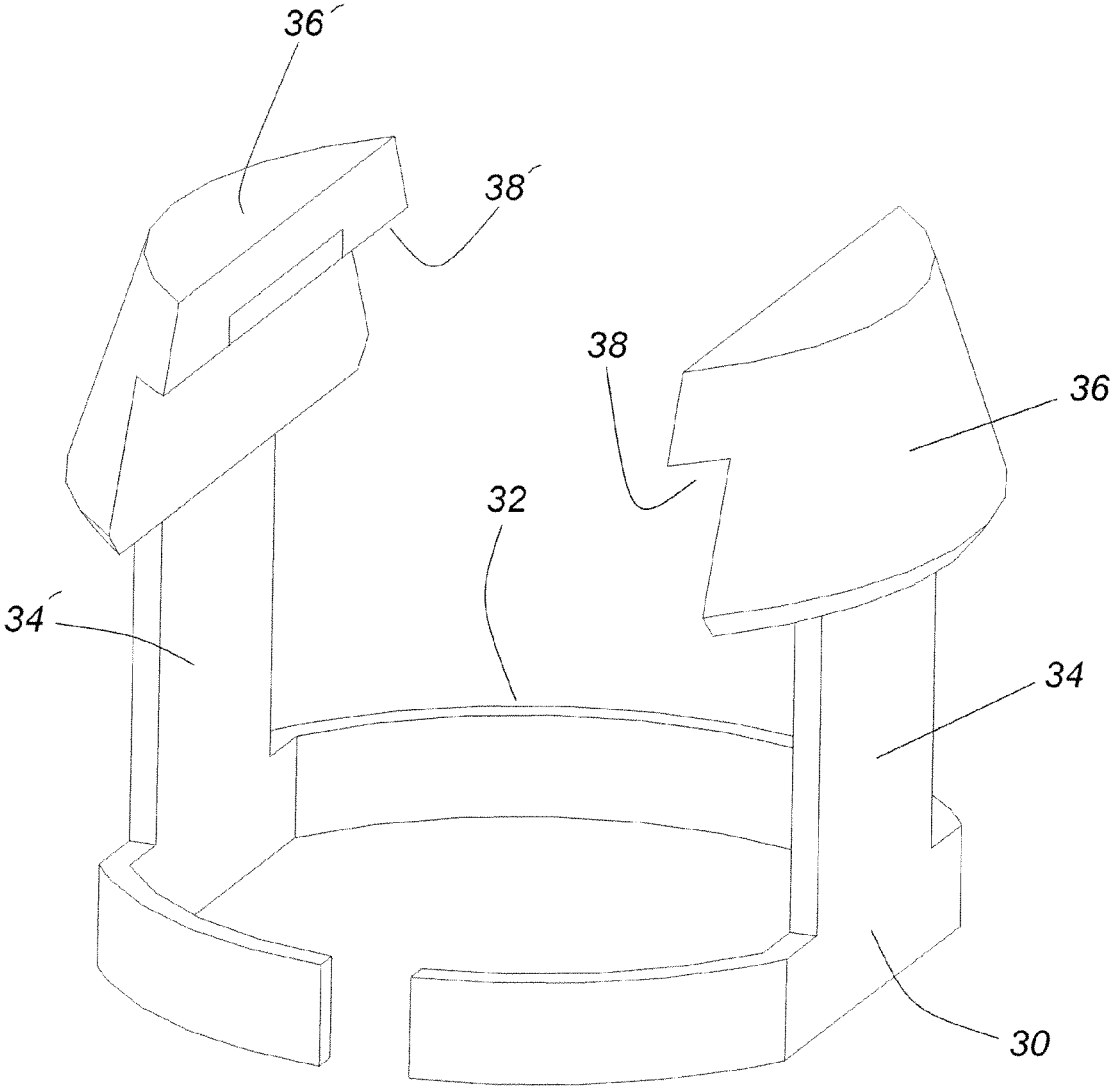
FIG. 3 is a perspective view of a first embodiment of the coupling, namely a clip, mounted on the locking core of FIG. 2.

In FIG. 2 and FIG. 3, an operating key OK is configured for insertion into the lock cylinder 20, along the longitudinal axis of the lock cylinder 20. When in use, the lock cylinder 20 is inserted into the cylinder housing port 6 of lock housing 2 so that retainers 36, 36' are securely connected to the driver 4. The driver 4 is associated with a typical locking system or locking assembly (which is not shown). When the lock cylinder 20 is inserted into the lock housing 2, the extended tumblers (not shown) extend into opposing tumbler channels 8, 8' while the lock cylinder 20 is in the locked position. When the operating key OK is fully inserted into the lock cylinder 20, the tumblers (not shown) are retracted, to allow the lock cylinder 20 to rotate within the lock housing 2 between a locked position and an unlocked position. A coupling in the form of a clip 30 is provided to operably connect the lock cylinder 20 to the driver 4. The base 32 of the clip 30 forms an expandable arcuate band which nests within a circumferential recess 22 extending across the lock cylinder 20. Opposing, parallel spring arms 34, 34' extend outwardly from the base 32, with ridges 38,38' on retainers 36,36' projecting inwardly so that the retainers 36,36' may selectively engage the driver 4 when the lock cylinder 20 is inserted in the lock housing 2, in the locked or unlocked positions.

Figure 4:
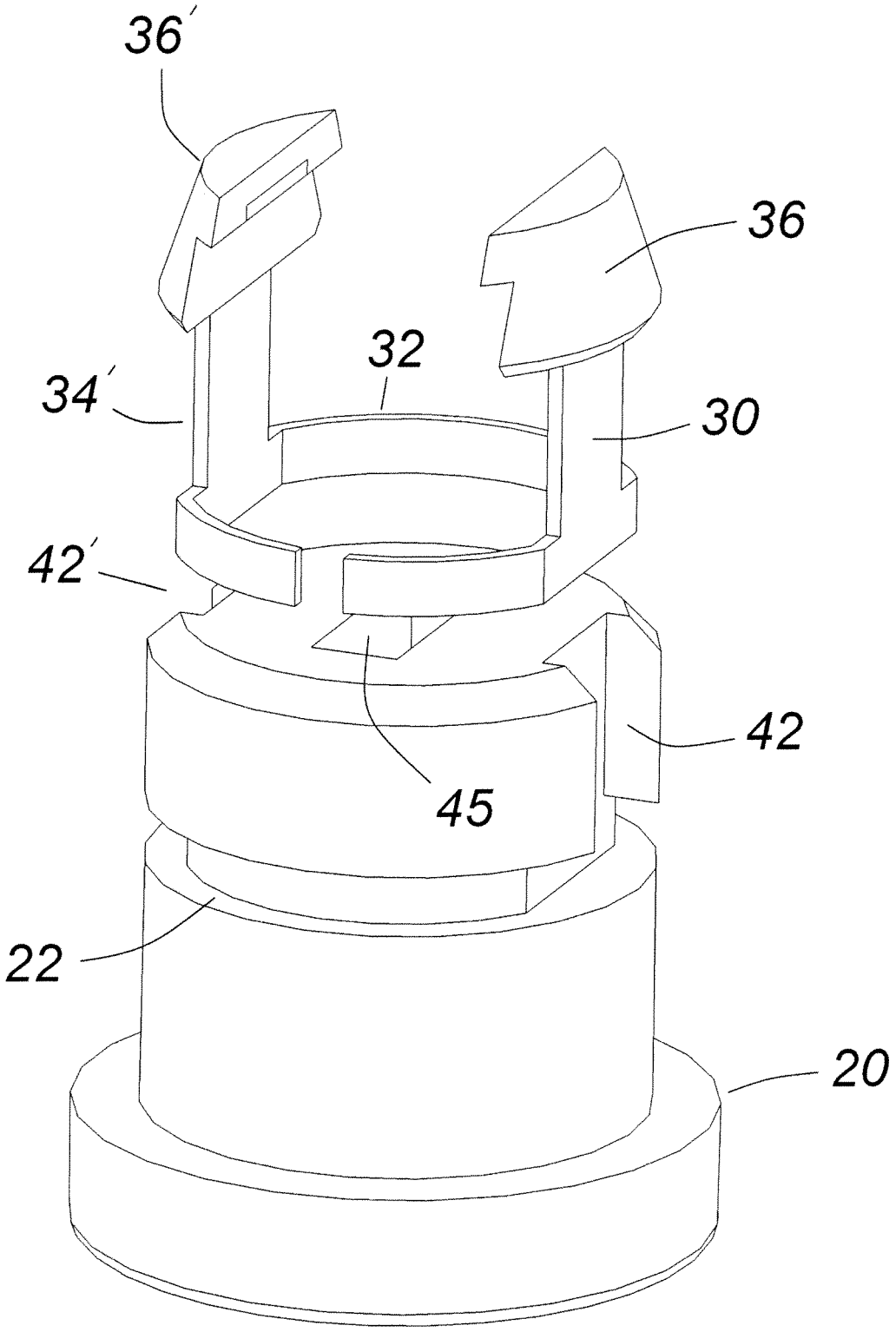
FIG. 4 is an exploded view in perspective of the first embodiment of the locking core and clip shown in FIG. 2.
Figure 5:
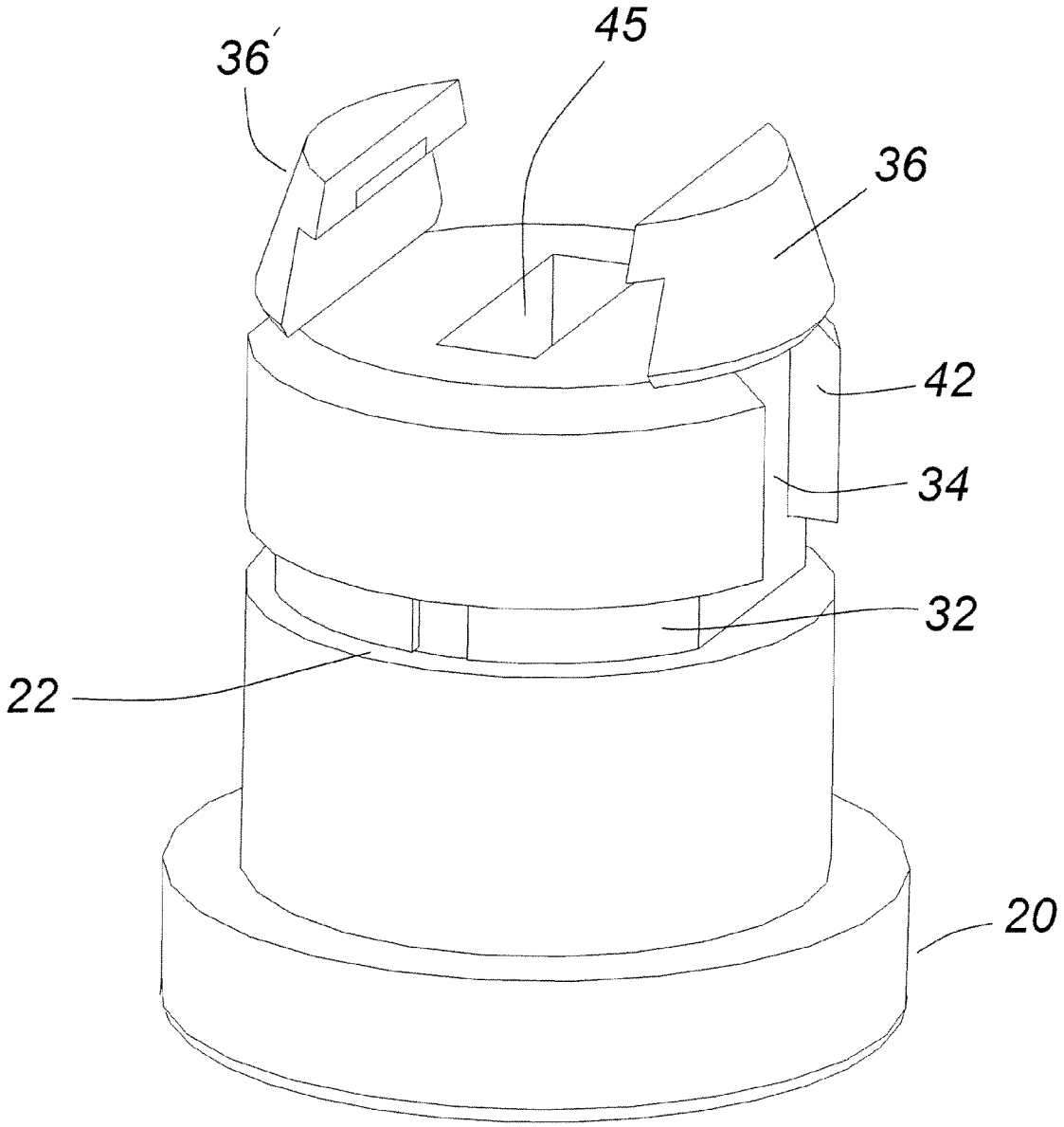
FIG. 5 is an enlarged perspective view of the first embodiment of the locking core and clip as assembled and shown in FIG. 2.

With reference to FIG. 4 and FIG. 5, the clip 30 may be slide-fit over a first end of the lock cylinder 20 so that the arcuate band 32 expands while sliding over the first end, and then the band 32 snaps inwardly, and contracts to engage channel 22. Channels 42, 42' receive corresponding spring arms 34, 34'. Keyway slot 45 extends along the length of the lock cylinder 20 through the center of the arcuate band 32 of the clip 30.

Figure 6:
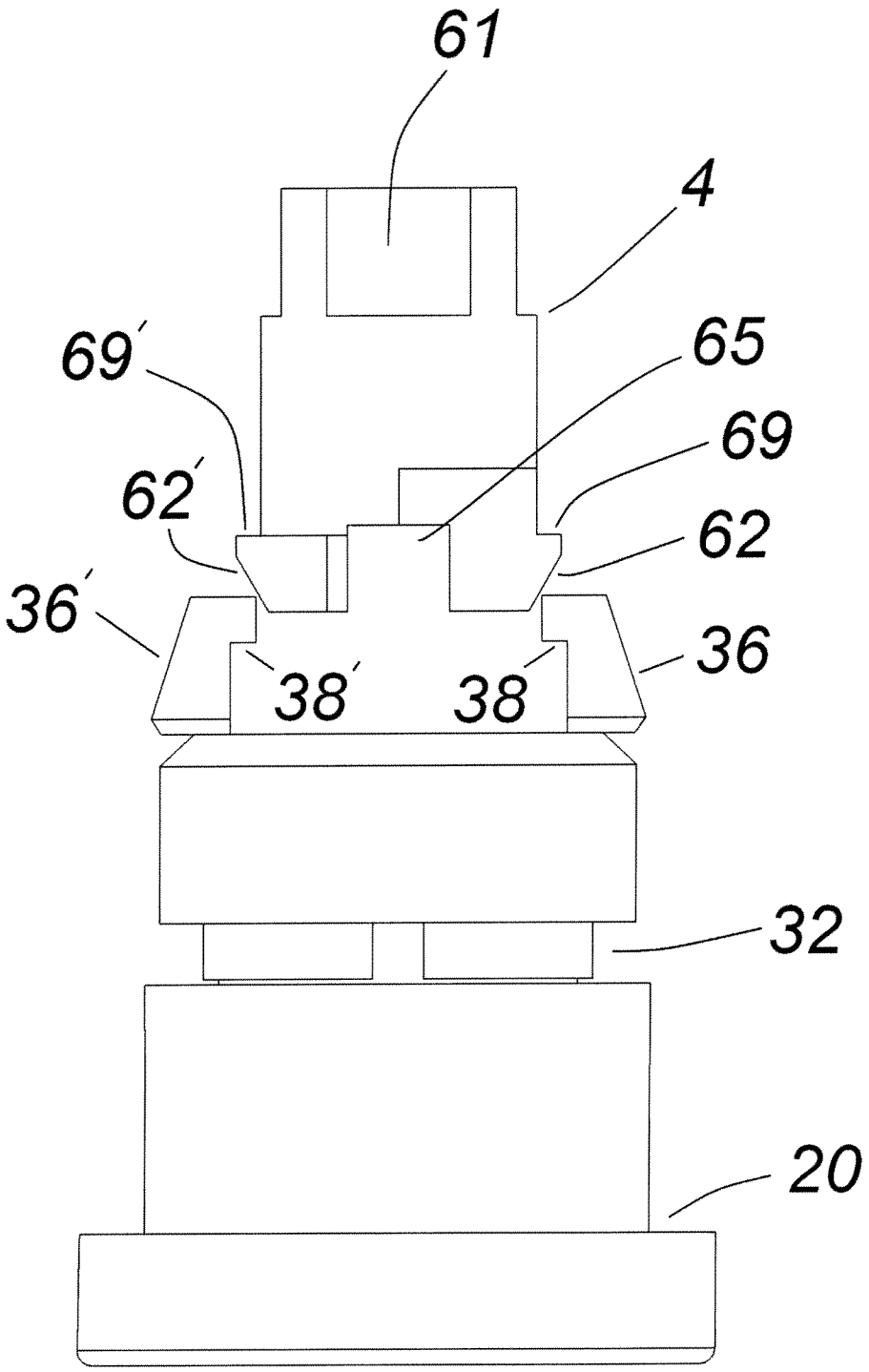
FIG. 6 is an enlarged frontal view of the first embodiment, in which the assembled locking core and clip are approaching a driver as shown in FIG. 2.
Figure 7:
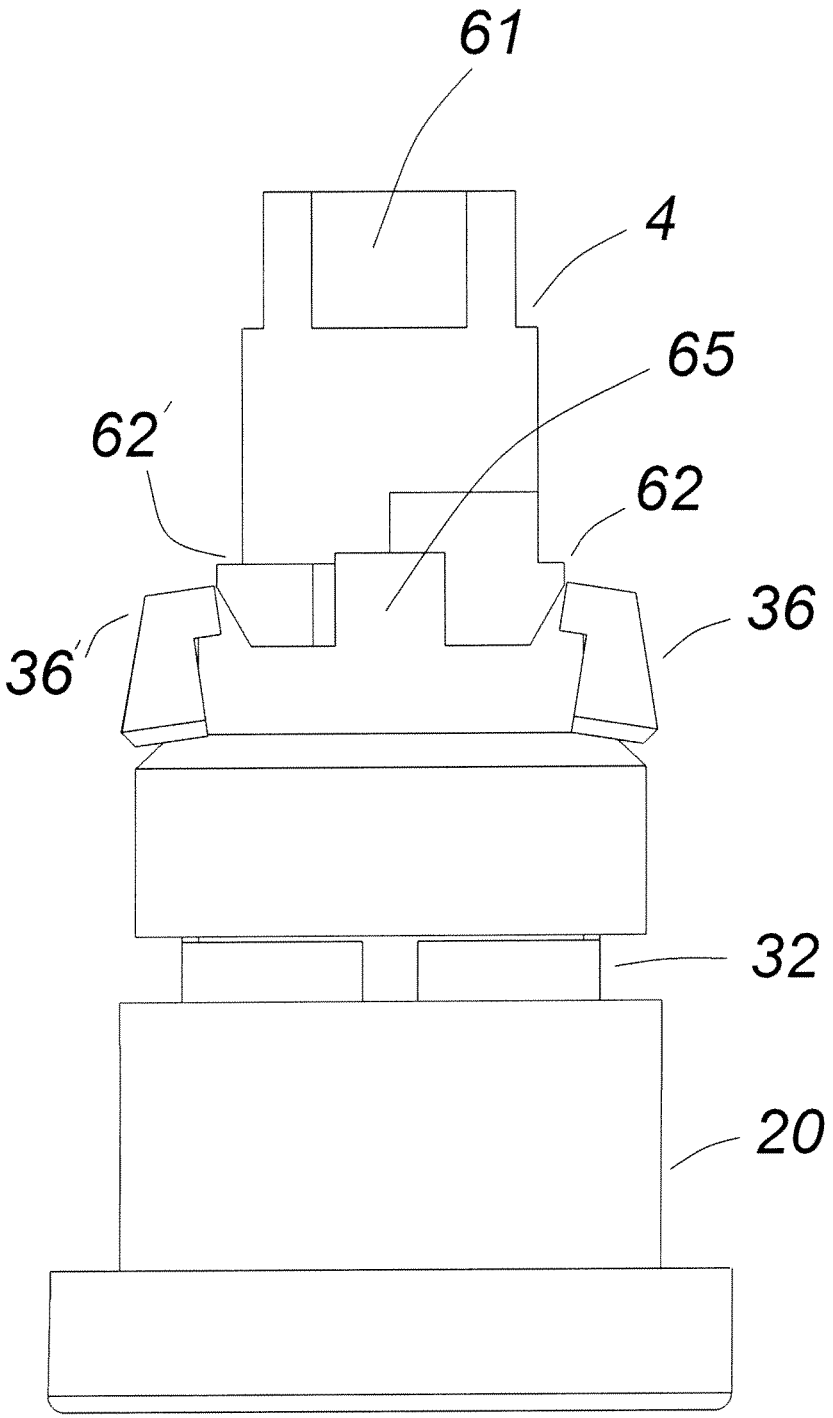
FIG. 7 is a frontal view of the first embodiment, in which the assembled locking core and clip are in partial engagement with the driver shown in FIG. 6.
Figure 8:
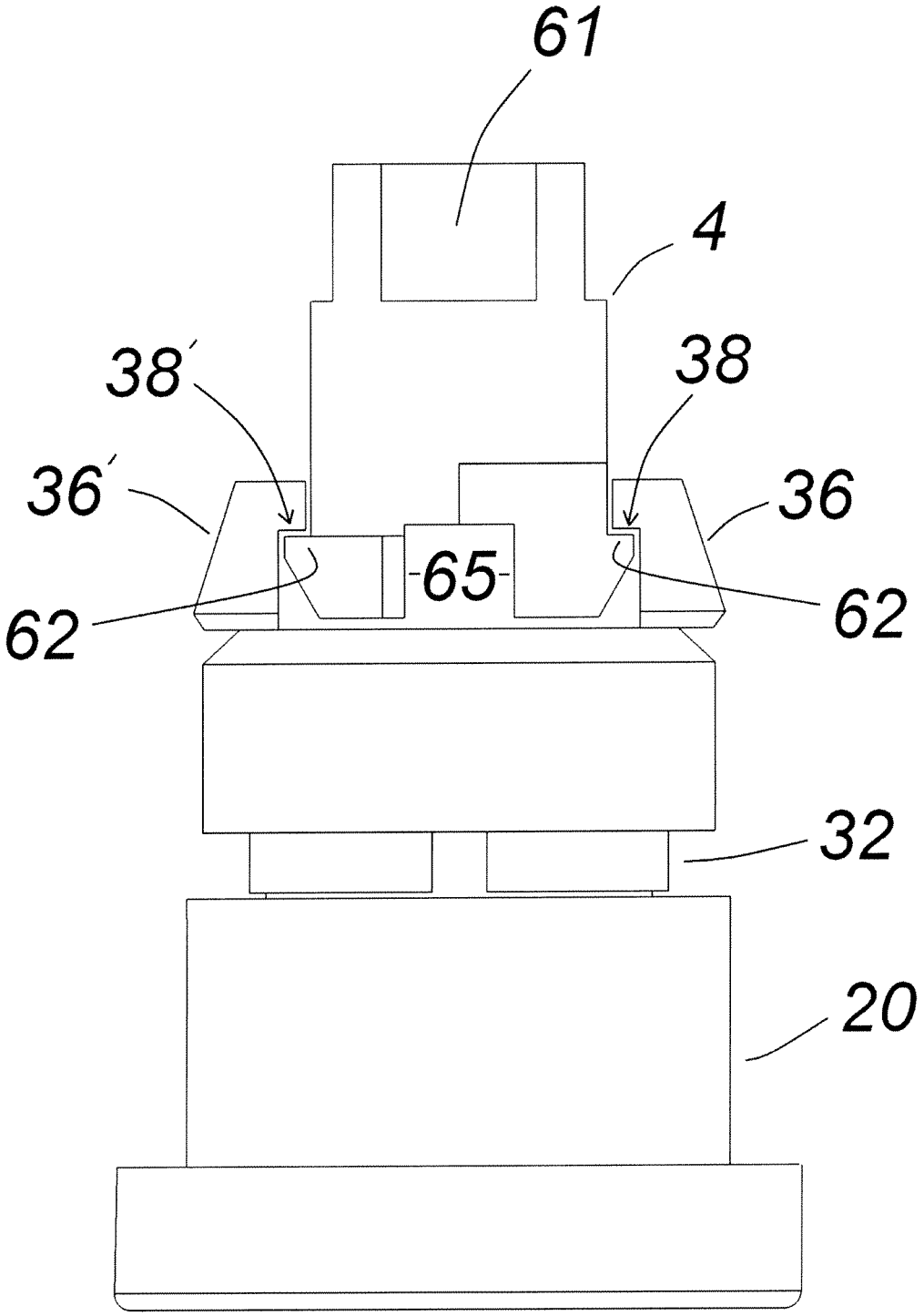
FIG. 8 is a frontal view of the first embodiment, in which the assembled locking core and clip are fully engaged with the driver shown in FIG. 5 and FIG. 6.
Figure 11:
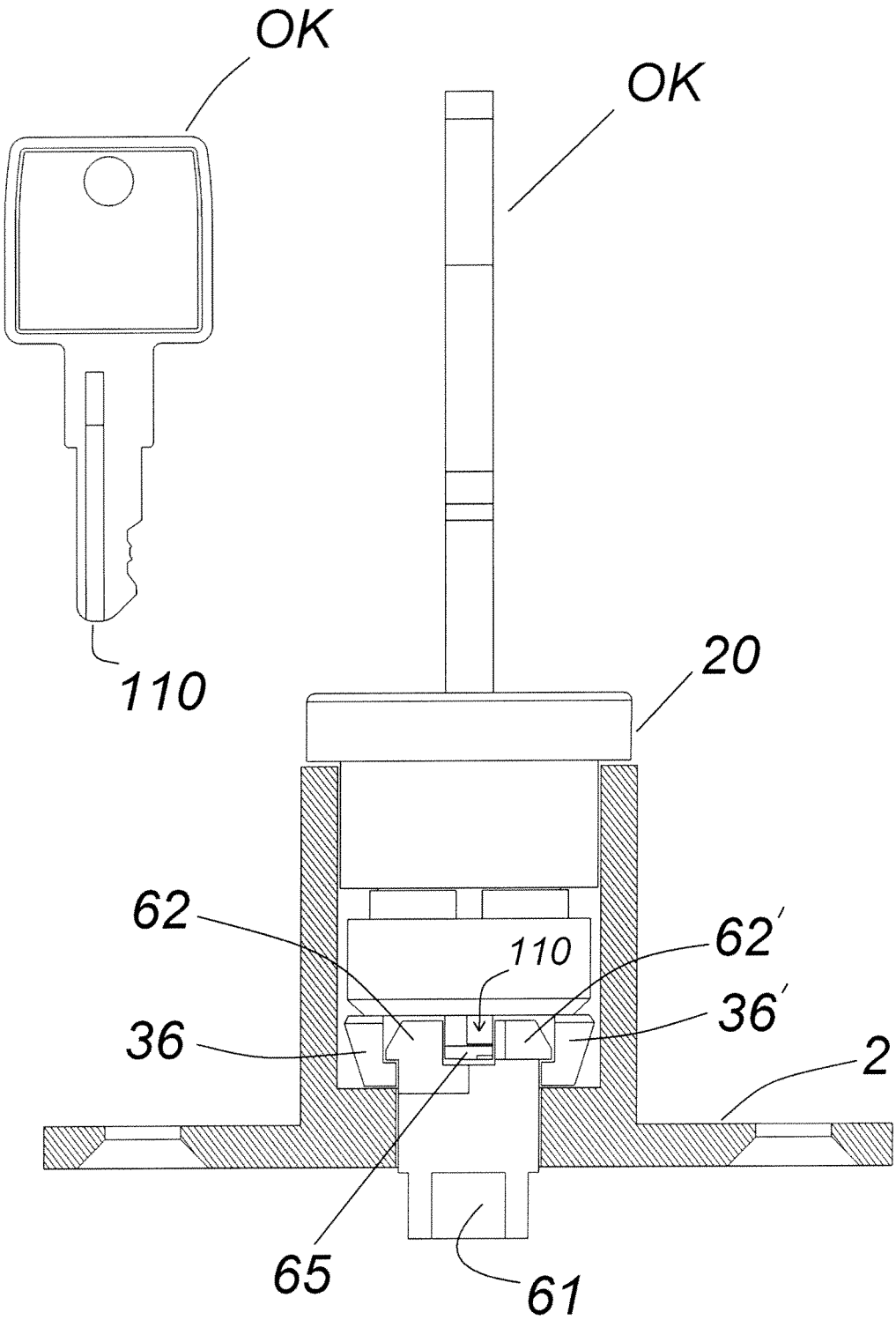
FIG. 11 is a frontal view, in partial section, of the first embodiment of the locking core and clip, in which an operating key is inserted through the locking core and into the driver, for operating the locking core and driver between locked and unlocked positions.

In FIG. 6, FIG. 7, and FIG. 8, the lock cylinder 20 including the attached clip are shown approaching the driver 4, prior to connection of the lock cylinder to the driver. The driver 4 is shown with driver socket 61 which is provided for operation of a cam or other components of an associated locking assembly (which is not shown herein). (In retrofit installations, it may be preferable to have the driver 4 in a position corresponding to a locked position of the lock assembly, in a defined orientation, for convenient attachment of the lock cylinder 20 to the driver 4.) An operating key slot 65 is defined between opposing beveled shoulders 62, 62' on outwardly projecting abutments 69, 69'. As the driver 4 approaches lock cylinder 20, the retainers 36, 36' travel outwardly along beveled shoulders 62, 62' and the associated spring arms 34, 34' are deflected outwardly away from the longitudinal axis. In FIG. 8, operating key slot 65 is aligned with keyway slot 45 in the lock cylinder 20 so that the leading edge 110 of the operating key OK may extend through the keyway slot 45 to fully engage the operating key slot 65 as shown in FIG. 11 for operation of a fully assembled locking assembly (not shown) between a first position (for example, a locked position) and a second position (in this example, being an unlocked position).

Figure 9:
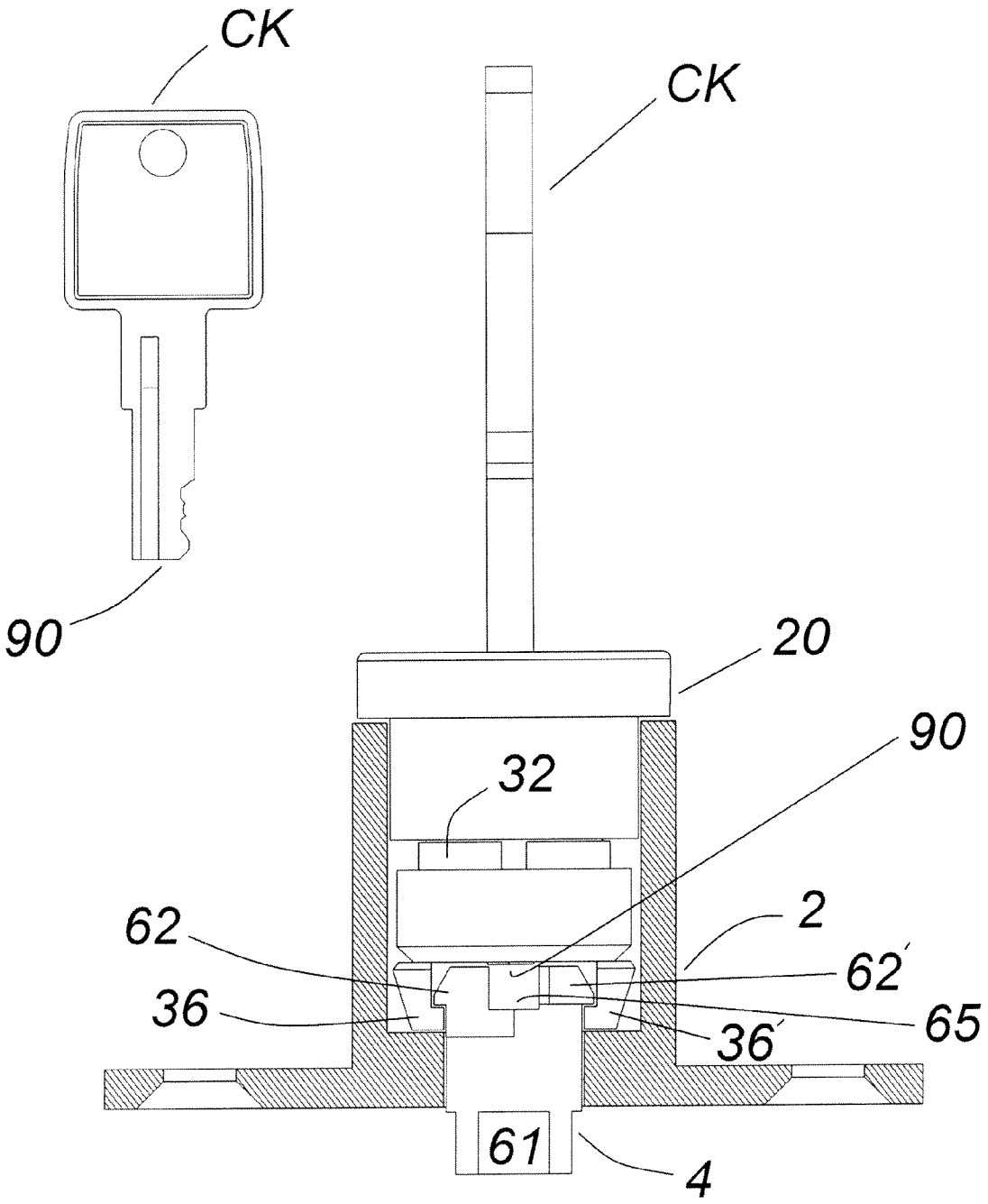
FIG. 9 is a frontal view, in partial section, of the first embodiment of the locking core and clip, in which a change key is inserted into the locking core, while the locking core and driver are engaged.
Figure 10:
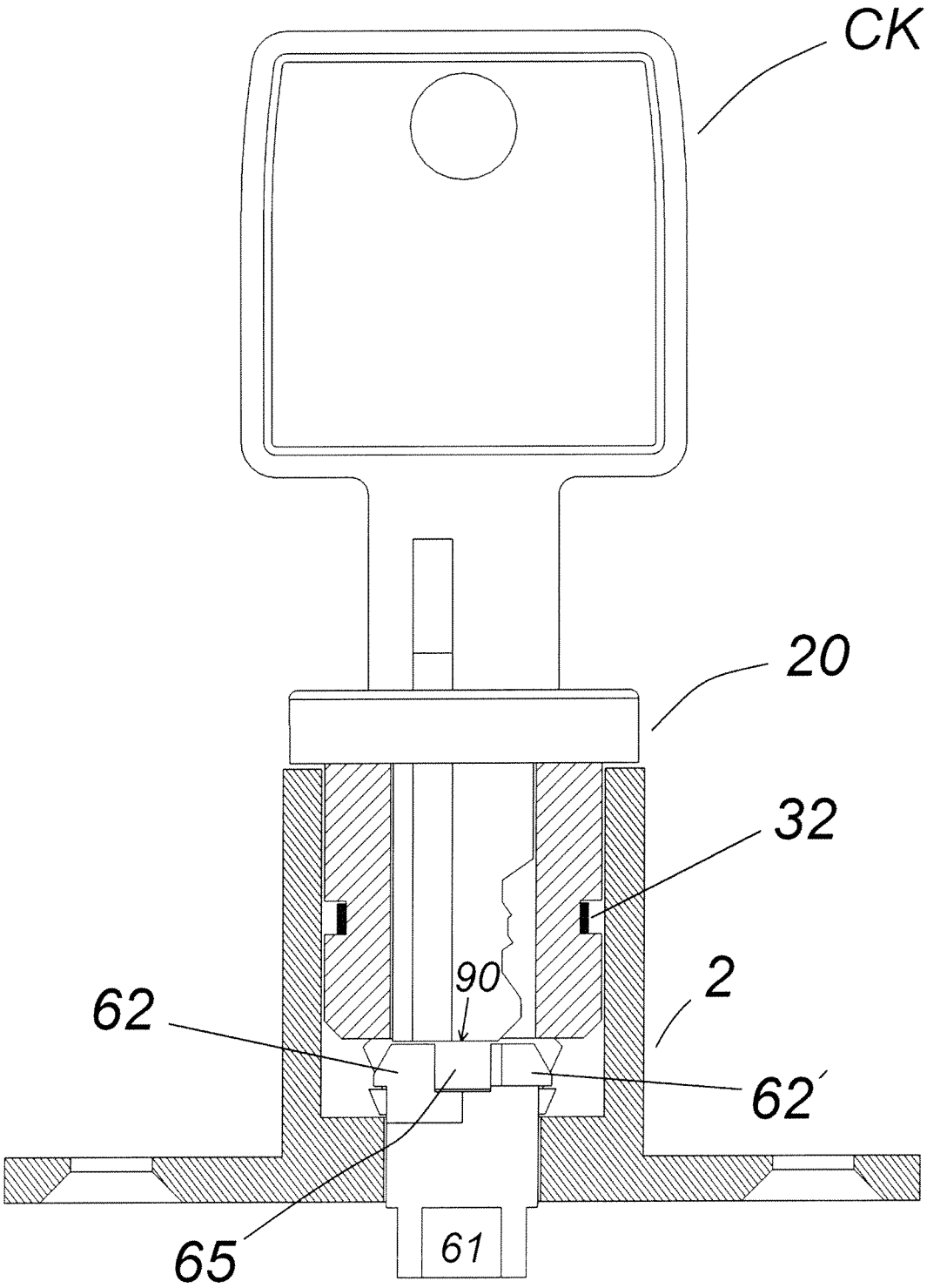
FIG. 10 is a frontal view, in partial section, of the first embodiment of the locking core and clip, in which the change key and the locking core have been rotated relative to the illustrated position in FIG. 9, and the locking core and driver are in position for disengagement.

FIG. 9 and FIG. 10 show change key CK fully inserted into the lock cylinder 20 such that the leading edge 90 of the key shaft tip does not engage operating key slot 65. In FIG. 9, the lock cylinder 20 is shown in a locked position with the retainers 36, 36' being fully engaged with outwardly projecting abutments 69, 69' to secure the driver 4 to the lock cylinder 20. The change key CK is configured to permit rotation of the lock cylinder 20 to a third position as shown in FIG. 10, in which the lock cylinder 20 may be disengaged from the driver 4 and withdrawn from the lock housing 2. By way of example, the change key CK may be configured to activate the tumblers in the lock cylinder 20 so that it may be disengaged and withdrawn when the lock cylinder 20 is moved to the third position. In FIG. 10, the change key CK is shown as having been rotated 90 degrees, into the third position, in which the retainers 36, 36' are no longer engaged with outwardly projecting abutments 69, 69'. In this position, the lock cylinder 20 and the clip 30 are disengaged from the driver 4 and may be removed from the lock housing 2.

FIGS. 12-20 provide a simplified illustration of a second embodiment of the present invention.

Figure 12:
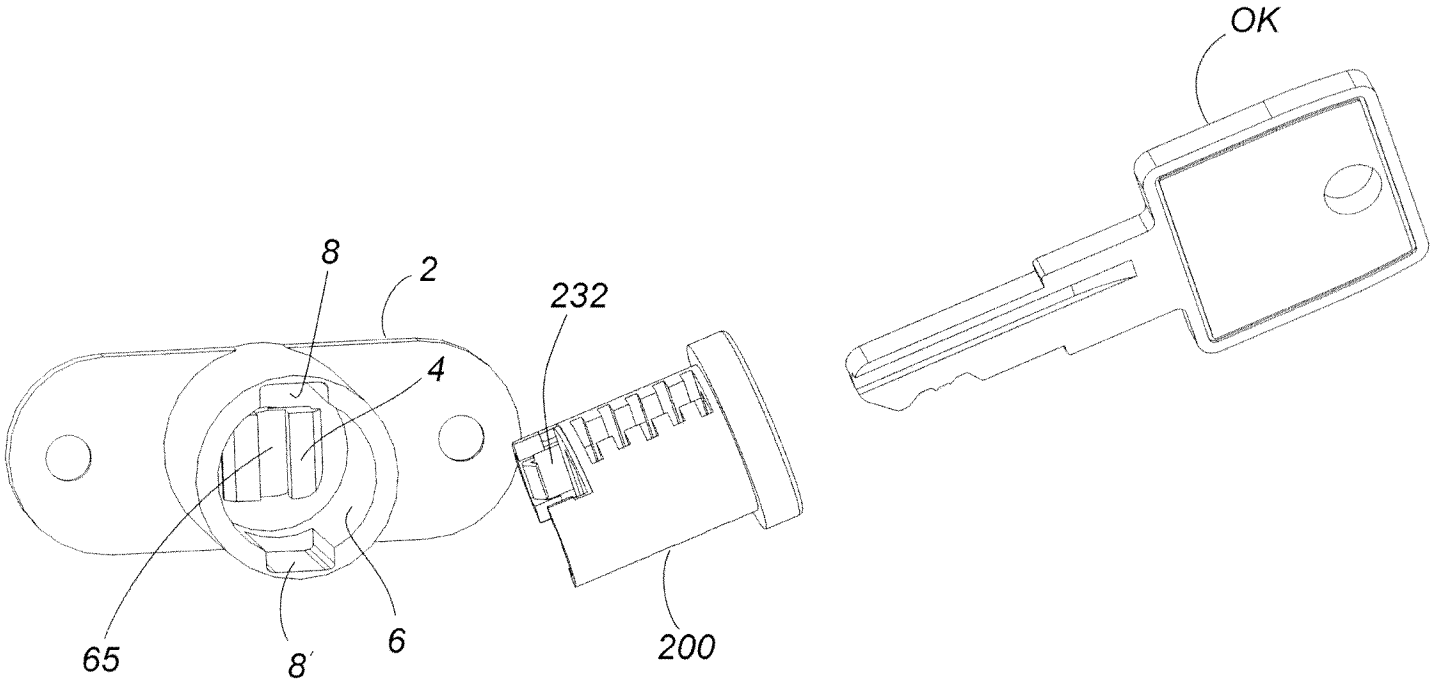
FIG. 12 is an exploded view of a second embodiment of a locking core of the invention along with a lock housing and operating key.

FIG. 12 shows an exploded view of an operating key OK along with a corresponding lock cylinder 200 positioned outside of a lock housing 2 similar in all essential respects to the lock housing 2 shown in FIG. 2. Similarly, in this example, the driver 4 shown in FIG. 12 is the same in all essential respects to the driver 4 illustrated in FIG. 2.

In this embodiment, driver clip 232 is securely nested in lock cylinder 200. The connection between driver clip 232 and the lock cylinder 200 may be configured to permit disengagement and removal of the driver clip from the lock cylinder. In this example, the driver clip 232 is removable.

Figure 13:
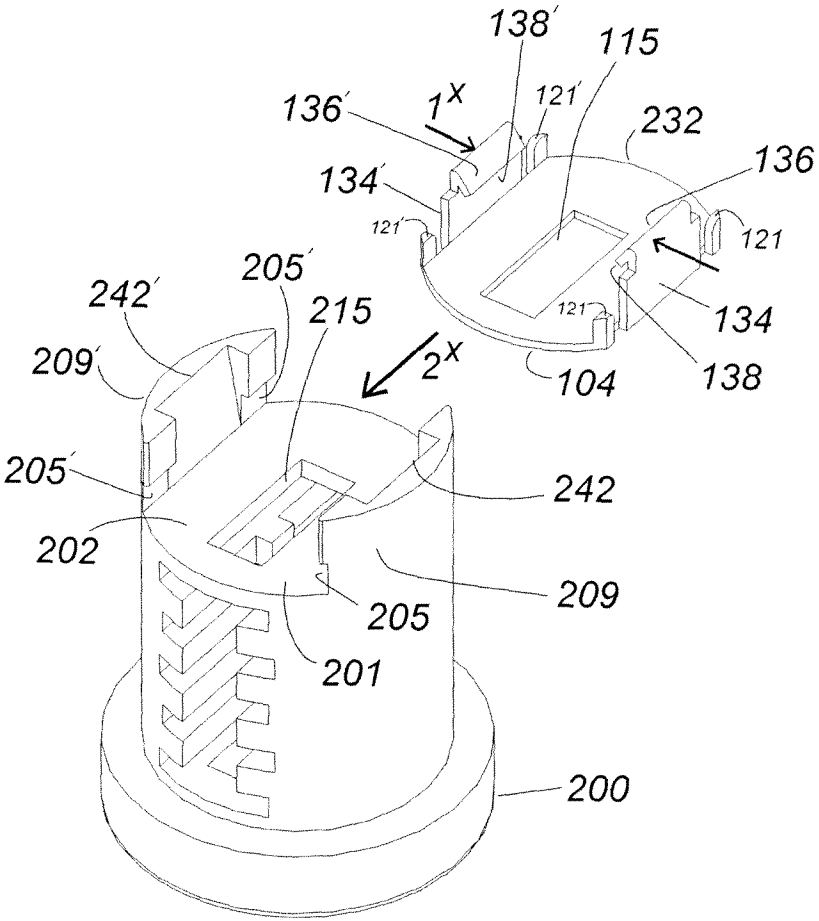
FIG. 13 is an exploded view in perspective of the second embodiment of the locking core and clip shown in FIG. 12.
Figure 14:
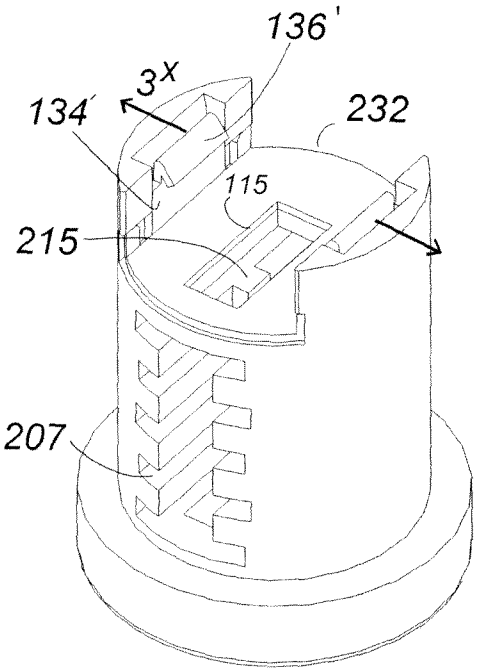
FIG. 14 is an enlarged perspective view of the second embodiment of the locking core and clip as assembled and shown in FIG. 12.

FIG. 13 and FIG. 14 illustrate a driver clip 232 made from a flexibly resilient material (for example, spring steel) having a clip base 104 and an operating key access defined by an opening 115 in the base 104. A pair of opposing spring arms 134, 134' project upwardly from the base 104. Retainer flanges 136, 136' which define corresponding flange edges 138, 138', project inwardly and downwardly toward the base 104 and opening 115. Lock cylinder 200 is provided with tumbler slots 207 to receive lock tumblers (not shown) positioned along the longitudinal axis of the lock cylinder 200, in communication with keyway slot 215. Lock cylinder 200 defines a bottom surface 202 of track 201 located between opposing cylinder legs 209, 209'. Cylinder legs 209, 209' project outwardly away from the lock cylinder, in parallel along the longitudinal axis of the lock cylinder 200. Cylinder legs 209, 209' define two outwardly beveled leg ways 242, 242' and corresponding positioning recesses 205, 205'.

In this embodiment, when driver clip 232 is moved in the transverse direction 2X (across the longitudinal axis of the lock cylinder 200), into track 201, upwardly projecting retainer posts 121, 121' travel along corresponding positioning recesses 205, 205'. Spring legs 134, 134' are deflected inwardly along direction 1X to pass by cylinder legs 209, 209'. When the driver clip 232 is centered within the track 201, operating key access 115 is aligned with keyway slot 215 of the lock cylinder 200. When the driver clip 232 is centered in this fashion, retainer posts 121, 121' engage the cylinder legs 209, 209' along positioning recesses 205, 205' to prevent displacement of the driver clip 232 along the longitudinal axis. Spring arms 134, 134' are biased to return to their at rest, upward positions to engage cylinder legs 209, 209' along beveled legways 242, 242' to prevent transverse displacement of the driver clip 232 relative to the lock cylinder 200. Similarly, spring arms 134, 134' are permitted to deflect outwardly (away from the longitudinal axis) in direction 3X when the lock cylinder and clip 232 are connected in the manner illustrated in FIG. 15, FIG. 16, and FIG. 17. The clip 232 is snap-fitted into removable engagement with the lock cylinder 200. (For example, when the lock cylinder 200 and snap-fitted clip 232 are located outside of the lock cylinder 2, the spring arms 134, 134' may be inwardly deflected along direction 1X. If desired, when the spring arms are inwardly deflected, the driver clip 232 may then be pushed transversely across the track 201, until the driver clip 232 is removed from the lock cylinder 200.)

Figure 15:
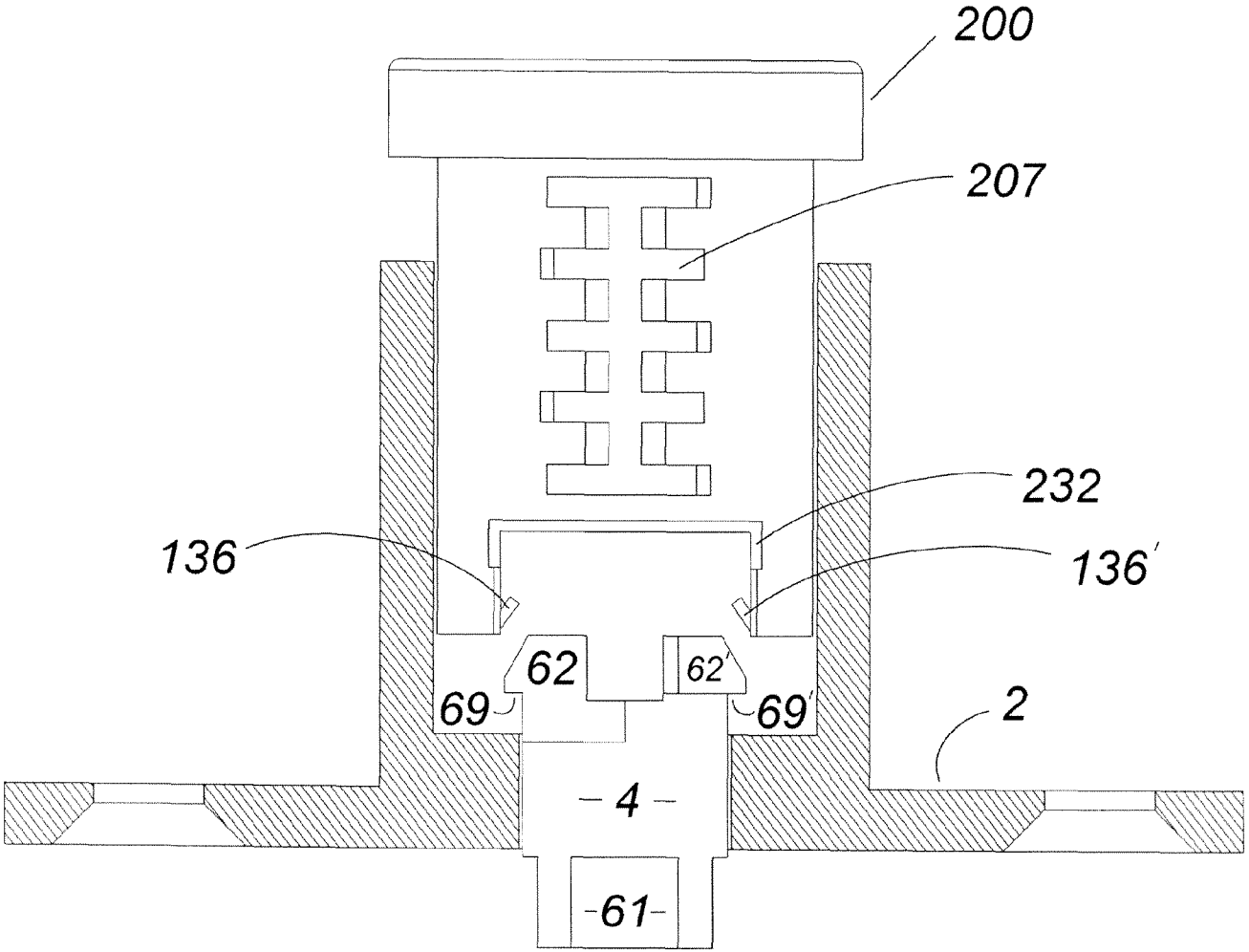
FIG. 15 is an enlarged frontal view of the second embodiment, in which the assembled locking core and clip are approaching a driver as shown in FIG. 12.
Figure 16:
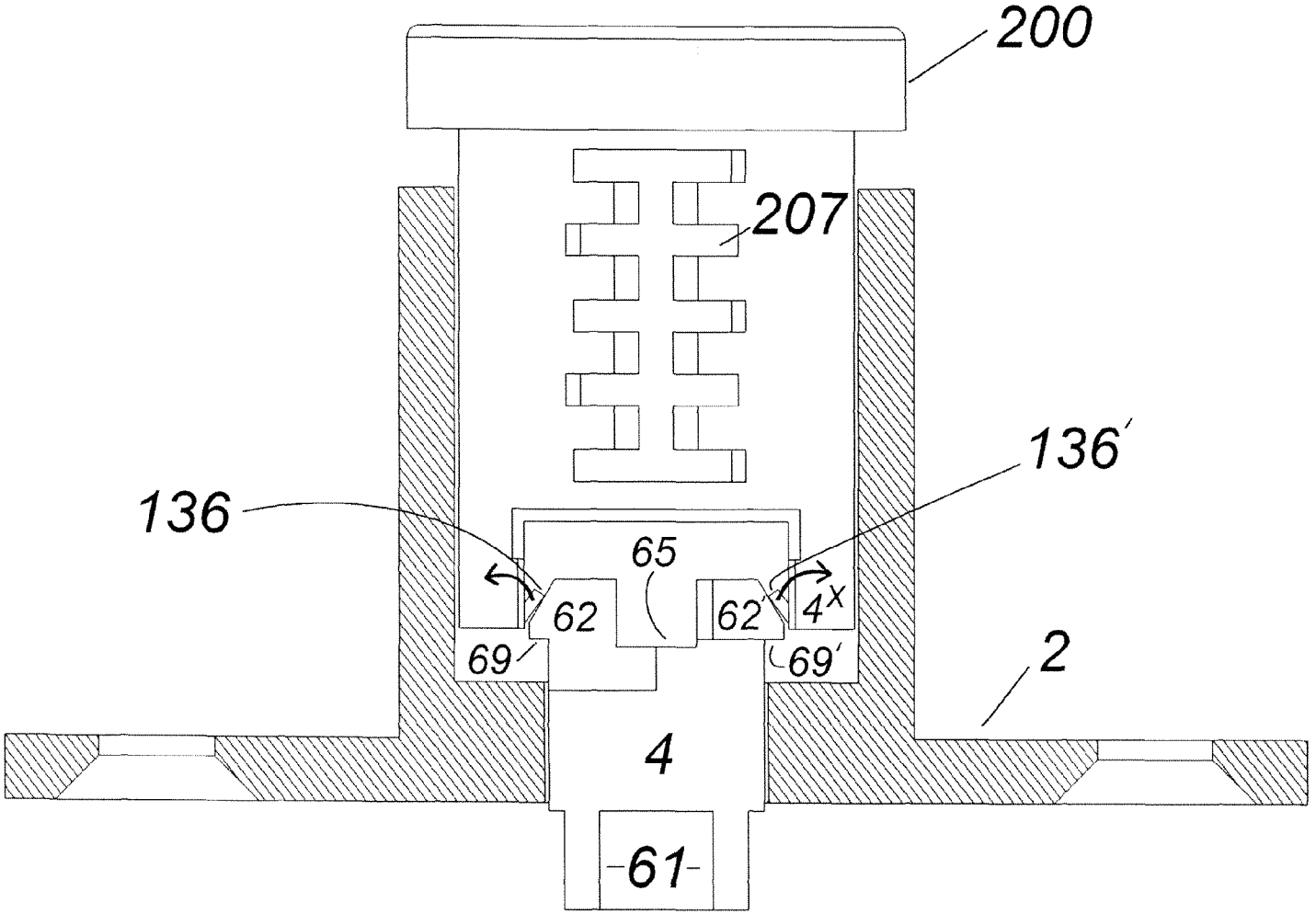
FIG. 16 is a frontal view of the second embodiment, in which the assembled locking core and clip are in partial engagement with the driver shown in FIG. 15.
Figure 17:
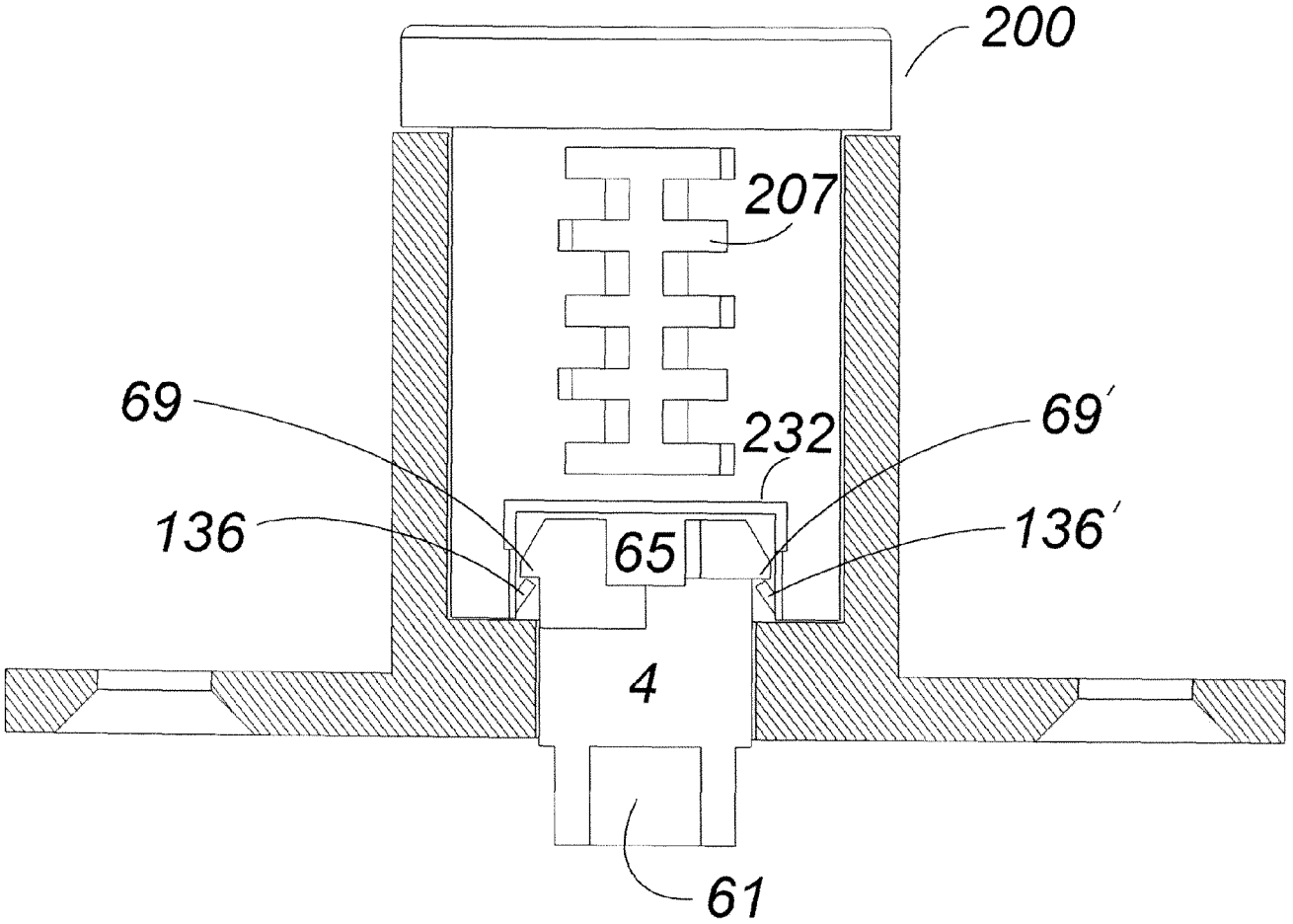
FIG. 17 is a frontal view of the second embodiment, in which the assembled locking core and clip are fully engaged with the driver shown in FIG. 15 and FIG. 16.

As illustrated in FIGS. 15-17, when the lock cylinder 200 and centrally nested driver clip 232 are moved into the lock housing 2, retainer flanges 136, 136' engage beveled shoulders 62, 62' of the driver 4 as the corresponding spring arms 134, 134' are deflected outwardly in direction 4X.

When the lock cylinder 200 is fully inserted into the lock housing 2, flange edges 138, 138' of retainer flanges 136, 136' engage outwardly projecting abutments 69, 69'.

In FIG. 18, when the lock cylinder 200 and the driver 4 are in the locked position, the change key CK is fully inserted into keyway slot 215, tumblers 190 are retracted, but the leading edge 90 of the key shaft tip does not extend into operating key slot 65 in the driver 4. When the change key CK is used to rotate the lock cylinder 20, relative to the driver 4, to the third position shown in FIG. 19 to permit disengagement of the driver clip 232 from the driver 4 and to permit extraction of the lock cylinder 200 from the lock housing 2.

FIG. 20 shows the operating key OK being fully inserted into the lock cylinder 200. The leading edge 110 of the operating key OK extends through keyway slot 215 and operating key access 115. When the operating key OK is fully inserted, the leading edge 110 engages operating key slot 65 so that the lock cylinder 200 and the driver 4 may be simultaneously rotated between the locked and unlocked positions.

Although the clip 30 and driver clip 232 are shown as examples of couplings which may be disengaged from the lock cylinder, other embodiments may be configured in which the couplings are not intended for easy removal after they are secured to a corresponding lock cylinder. Similarly, the modified embodiments of the coupling may be configured to directly or indirectly connect and disconnect from another form of driver component in a locking assembly. Other variations and modifications are also possible.

The foregoing examples are preferred embodiments of the invention. It will be apparent to those skilled in the art that additional embodiments are possible and that such embodiments will fall within the scope of the appended claims.

The invention claimed is:

1. A locking core for rotational operation within a lock housing, the core comprising a proximate and a distal end, the core defining a longitudinal axis and a cylindrical longitudinal surface between the proximate end and the distal end, the surface defining a channel, the channel defining a plane extending transversely across the axis, a flexibly resilient coupling comprising a base for removably engaging the channel, when in use, the coupling removably engages the core with a driver in a locking assembly, the coupling comprising a pair of opposing flexibly resilient arms for removably engaging a pair of corresponding recesses defined by the driver.

2. The locking core claimed in claim 1, each of the flexibly resilient arms defining a distal end away from the base, the distal end defining a rigid flange extending inwardly toward the base.

3. The locking core claimed in claim 2, the distal end is partially encased in a casting extending about the rigid flange, the rigid flange defining an exposed surface for engagement with one of the corresponding recesses.

4. The locking core claimed in claim 1, the flexibly resilient arms are biased for movement inwardly toward the longitudinal axis for engagement with the driver.

5. The locking core claimed in claim 1, the corresponding recesses in opposing arrangement, extending parallel to the longitudinal axis for receiving the flexibly resilient arms, the arms being configured to engage the driver.

6. The locking core claimed in claim 1, the flexibly resilient arms deflecting outwardly away from the longitudinal axis when the locking core is moved toward the driver, and subsequently deflecting inwardly to removably engage the locking core with the driver.

7. The locking core claimed in claim 1, the base defining a planar surface and a pair of opposing abutments extending upwardly from the base for engagement with the channel, the base defining an opening for receiving a distal tip of an operating key for engagement with the driver.

8. The locking core claimed in claim 1, the locking core defining a pair of opposing legs extending parallel to the longitudinal axis, the pair of corresponding recesses being defined by inwardly facing surfaces on the pair of opposing legs.

9. The locking core claimed in claim 1, the pair of corresponding recesses sloping outwardly from the longitudinal axis and away from the channel.

10. The locking core claimed in claim 1, the channel extending about an arcuate peripheral surface defined by the locking core, the base comprising an arcuate band for engagement with the channel.

11. The locking core claimed by claim 1, the base defining a planar surface and a pair of opposing walls for engagement with the channel, adjacent a second planar surface extending along the channel.

12. The locking core claimed in claim 1, the base defining an opening for receiving a distal tip of an operating key for engagement with the driver.

13. The locking core claimed in claim 1, the base is snap fit for securably engaging the channel, to prevent disengagement of the coupling from the locking core.

14. The locking core claimed in claim 1, the coupling is removable from the locking core by deflecting a portion of the base from the channel, and sliding the base away from the locking core.

15. The locking core claimed in claim 1, the coupling is engaged with the locking core either: (i) by deflecting a portion of the base outwardly away from the longitudinal axis and sliding the base axially along the locking core for engagement with the channel or (ii) by deflecting a portion of the coupling inwardly toward a central axis defined by the coupling and by sliding the base transversely across the longitudinal axis.

16. The locking core claimed in claim 1, when in use the locking core operates between a first position for locking an associated storage compartment and a second position for unlocking the associated storage compartment, and the locking core operates between either: (i) the first position and a third position, or (ii) the second position and the third position, for disengagement of the locking core from the driver.

17. A cylindrical locking core for rotational operation within a lock housing in a locking assembly for selectively locking and unlocking a storage unit, the locking core defining a cylindrical surface along a longitudinal axis, between a proximate end of the locking core and a distal end of the locking core, the cylindrical surface defining a channel extending transversely across the axis, a flexibly resilient coupling comprising a base for removably engaging the channel, and when in use, the coupling releasably secures the locking core to a driver in the locking assembly, the coupling comprising a pair of opposing flexibly resilient arms extending coaxially away from the base, the arms being biased inwardly for movement toward the axis to engage the driver.

18. The cylindrical locking core as claimed in claim 17, the channel defines either (a) a planar surface extending across the axis or (b) an arcuate path extending transversely about the axis, the coupling comprising a flexibly resilient clip, the base being snap-fitted into the channel.

19. The cylindrical locking core as claimed in claim 17, the locking core being cast from a rigid first material and the coupling being formed from one or more other materials, consisting essentially of flexibly resilient steel.

20. The cylindrical locking core as claimed in claim 17, the coupling comprising a pair of opposing rigid flanges projecting inwardly toward the axis for releasably engaging a pair of corresponding recesses defined by the driver in the locking assembly.

* * * * *